United States Patent [19]

Adams

[11] 4,202,146

[45] May 13, 1980

[54] TRANSPORTABLE MODULE FOR TRILEVEL DWELLING

[76] Inventor: William C. Adams, 2822 SE. 8th St., Ocala, Fla. 32670

[21] Appl. No.: 16,720

[22] Filed: Mar. 1, 1979

[51] Int. Cl.[2] ..... E04H 3/00

[52] U.S. Cl. ..... 52/236.4; 52/79.3; 52/143

[58] Field of Search ..... 52/236.4, 236.3–236.9, 52/79.3, 79.1, 79.5, 143, 185

[56] References Cited

U.S. PATENT DOCUMENTS

| | | | |
|---|---|---|---|
| 2,154,142 | 4/1939 | Whelan . | |
| 3,292,327 | 12/1966 | van der Lely . | |
| 3,422,582 | 1/1969 | van der Lely . | |
| 3,510,997 | 5/1970 | Ratych . | |
| 3,593,471 | 7/1971 | Fields | 52/79.5 X |
| 3,609,929 | 10/1971 | Brown et al. . | |
| 3,629,983 | 12/1971 | Jenn . | |
| 3,832,811 | 9/1974 | Briel . | |
| 3,884,001 | 5/1975 | Tylius | 52/236.4 X |
| 4,078,343 | 3/1978 | Moore | 52/79.1 |
| 4,120,133 | 10/1978 | Rodgers | 52/236.3 X |

*Primary Examiner*—J. Karl Bell

*Attorney, Agent, or Firm*—Norman B. Rainer

[57] ABSTRACT

A factory-constructed module is provided having lower and middle dwelling compartments, a storage compartment, and provision for on-site completion of a third dwelling compartment to produce a split-level residential house. The module is transportable on the highways as a trailered unit having a maximum height compatible with public highway regulations. The module constitutes a major portion of the completed split-level house and contains substantially all the plumbing and electrical wiring required by said house, including electric service receptacles installed in the floor of said third dwelling compartment.

7 Claims, 6 Drawing Figures

TRANSPORTABLE MODULE FOR TRILEVEL DWELLING

BACKGROUND OF THE INVENTION

This invention relates to a dwelling fabricated to a major extent in a factory as a transportable module assembly, the complete fabrication of said dwelling being achieved when said module assembly is situated on the intended site for said dwelling.

It is well known to construct dwellings such as residential houses by assembling at the intended site of the house component units which have been fabricated in a factory and shipped to the house site. The component units, generally modules representing one or more rooms of the ultimate dwelling, may vary considerably in their width and length. Their height however, is generally consistent with an interior floor-to-ceiling height of 7 to 8 feet which prevails in the majority of currently constructed dwellings in the United States. The floor and ceiling structure of said modules may occupy another six to twelve inches of height, thereby causing the total height of a module comprising a single room or several rooms on the same horizontal level to be 8 to 9 feet. Transportation of such modular component units is generally achieved by truck so that delivery can be made directly to the building site.

There are certain practical and legally imposed restrictions as to the maximum height that any portion of a truck or its load can rise above the surface of the highway. Such restrictions are imposed in view of the many overhead structures such as elevated roadways associated with highways systems. Current regulations in the United States specify that said maximum height is 13'-6". Because of such restrictions, two modules cannot be transported one on top of the other. A height interval therefore exists between the height of a single level housing module which may be positioned on a truck, and its maximum permissible elevation. The magnitude of said height interval is further influenced by the distance of elevation of the bottom of said module above the highway. Said height interval generally remains unutilized with respect to accommodation of integral portions of the ultimate dwelling.

In the construction of multi-storied dwellings having two or more floor levels, arrangement of modules in dispositions stacked one on top of another or in side-by-side relationship is well practiced but generally requires considerable on-site specialized construction and finishing techniques which includes the need for heavy equipment to lift and position modules. Each truckload of modules is taxed by federal and local governments, thereby further increasing the cost of multi-modular housing. The assembly and finishing of modular-based dwellings having a split level design wherein floor levels are spaced less than 7 feet apart is usually more difficult than assembly of the simpler stacked or side-by-side designs. The increased amount of special techniques, labor and equipment involved in creating a finished split level dwelling from separate modules results in higher total cost of the final product.

It is an object of the present invention to produce a dwelling from a manufactured integral modular component which will occupy substantially maximum permissible highway transportation height.

It is another object of the present invention to provide a dwelling of split level design which, in partially constructed form will occupy substantially the maximum permissible highway transportation height as a manufactured integral component of said dwelling, and which can be completely finished on a desired site without need for attachment of modules or need for heavy construction equipment.

It is a further object of the present invention to provide a low cost split level design dwelling of the aforementioned nature, the construction of which is completed at the desired site of the dwelling by finishing a single modular unit which can be transported on public highways.

It is a still further object to provide a dwelling of the aforementioned nature wherein said modular unit achieves practical functional utilization of the height interval between the height of a single level module and its maximum permissible elevation above a highway.

These objects and other objects and advantages of the invention will be apparent from the following description.

SUMMARY OF THE INVENTION

The above and other beneficial objects and advantages are accomplished in accordance with the present invention by the provision of a factory-constructed housing module adapted for trailered transportation comprising a first and a second dwelling compartment positioned above a rectangular foundation floor extending the entire length and width of said module and having wheels on its underside, exterior vertical walls circumscribing the perimeter of said foundation floor, a short staircase extending from said foundation floor in said first compartment to a second floor of said second compartment, a long staircase positioned adjacent said short staircase and angled in the opposite direction therefrom extending from said second floor to a third floor positioned above said foundation floor and laterally displaced from said second floor, and a first roof positioned atop the wall structure bounding said second compartment at an elevation above said third floor.

The aforesaid general configuration of the housing module of this invention provides a storage compartment positioned between said foundation floor and second floor and bounded on three sides by the lower portions of the walls which bound said second compartment. Because of the trailered design of the module, whereby said foundation floor may be positioned closely adjacent the highway, said storage compartment has a useful height which could not be obtained in modules simply designed for placement upon a truck or its trailer for transportation.

The aforementioned third floor constitutes the ceiling for said first compartment and is adapted to be bounded by vertical walls and a second roof to achieve formation of a third compartment.

Said first roof is the highest elevation of the module of this invention and has a height such that, with adequate clearance of said foundation floor above a highway, the overall height of the module is within permissible criteria for transportation on public highways.

The module comprising first and second compartments is constructed in a factory operation utilizing fabrication techniques involving welding, riveting, adhesive bonding, swaging, thermal bonding, long extruded stock and other methods and materials which cannot be readily utilized in field fabrication methods. The third compartment is assembled by field fabrication methods employing threaded fasteners and the like from parts and assemblies of manageable dimensions which may be transported within said module.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
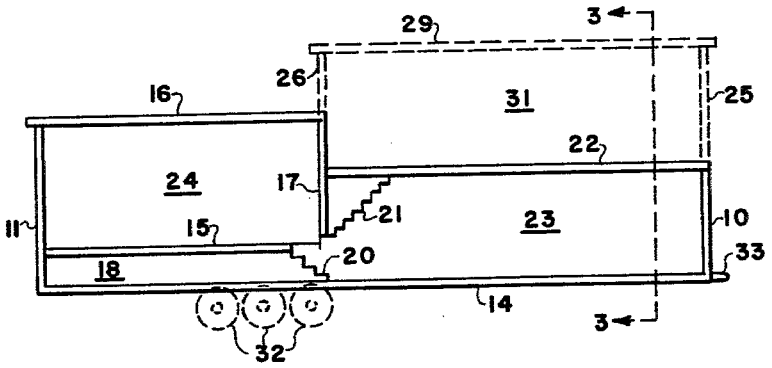
FIG. 1 is a longitudinal sectional elevational view of an embodiment of the module of the present invention.
Figure 3:
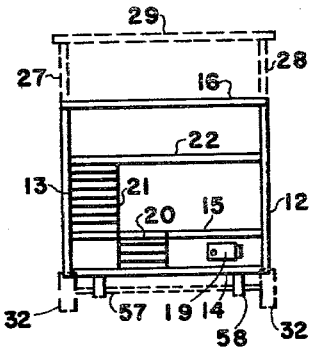
FIG. 3 is a sectional view taken along the lines 3—3 of FIG. 1.
Figure 2:
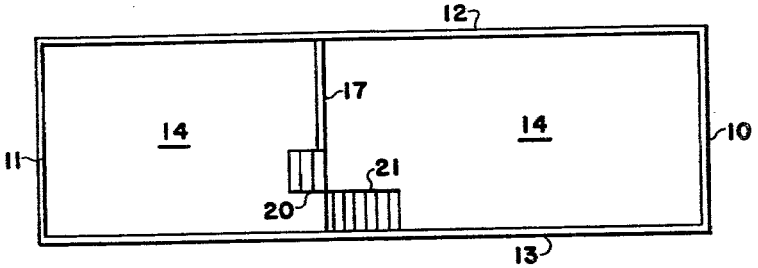
FIG. 2 is a plan view of the module of FIG. 1.

Referring to FIGS. 1 and 2, front wall 10, rear wall 11 and side walls 12 and 13 extend vertically upward from foundation floor 14. Second floor 15 extends from rear wall 11 to interior wall 17 disposed parallel to front wall 10 and positioned at a site substantially centrally located along the length of foundation floor 14. Said second floor is vertically spaced from foundation floor 14 by a distance of between about 25 inches and 50 inches. A first roof 16 is positioned atop walls 11, 12 and 13, said roof extending from rear wall 11 to interior wall 17. The space confined by second floor 15, foundation floor 14 and the lowermost portions of walls 11, 12, 13 and 17 is a storage compartment 18 which is provided with at least one access door 19 located in any of its four boundary walls.

A short staircase 20 leads from foundation floor 14 to second floor 15 at a site generally adjacent interior wall 17. Said short staircase intrudes into storage compartment 18 insofar as the space occupied by said staircase would otherwise be part of said storage compartment. A long staircase 21 leads from second floor 15 to a third floor 22 laterally and vertically displaced from second floor 15 and positioned above foundation floor 14. Both the short and long staircases are positioned such that adequate head room will exist relative to the overhead third floor 22 and first roof 16. Said positioning is preferably achieved by causing each staircase to begin its ascent at a site substantially in line with interior wall 17.

The space generally defined by third floor 22, foundation floor 14, front wall 10, interior wall 17, and side walls 12 and 13 represents first dwelling compartment 23. The space generally defined by first roof 16, second floor 15, rear wall 11, interior wall 17, and side walls 12 and 13 represents second dwelling compartment 24.

The nature of the construction of the module comprised of said storage compartment and first and second dwelling compartments is such as to be amenable to fabrication by rapid, inexpensive mass-production techniques. The wall, floor and roof members may be comprised of wood, metal, concrete, plastics or composite structures thereof, or other suitably rigid and durable materials. Structural components made from wood may be fabricated by the assembly of pre-cut pieces using rapid joining techniques. Thermal insulation of cellular or fibrous nature may be incorporated within composite panel structures. Honeycomb structural panels may also be utilized where high strength and light weight is required. Similarly, plastic panels reinforced with fiberglass, and laminated structures may be employed in conjunction with specialized fastening techniques adapted to such materials. Various trim and functional components of the module such as fascia, moldings, eaves troughs, kitchen cabinets, bathroom fixtures, window and door units, pipes, and the like may be fabricated from extruded stock of continuous length, large pre-cast monolithic structures or pre-assembled units. The nature of the materials and assembly techniques utilized in the fabrication of said module are adaptable to factory-type methods which may involve large complex fabricating equipment or specialized handling conditions. Such methods also achieve high efficiency of utilization of skilled laborers whose total time may be devoted to their craft and not diminished by the need to travel to and from various building sites.

It is particularly significant that the module unit comprised of said first and second dwelling compartments is provided with substantially all the plumbing, electrical wiring and installed applicances and fixtures required by the furnished dwelling. The remaining construction needed to complete a dwelling based upon the module of this invention requires substantially no special skills or specialized equipment. Such remaining construction can in fact be done by the purchaser of the module in order to save on further construction costs.

Figure 4:
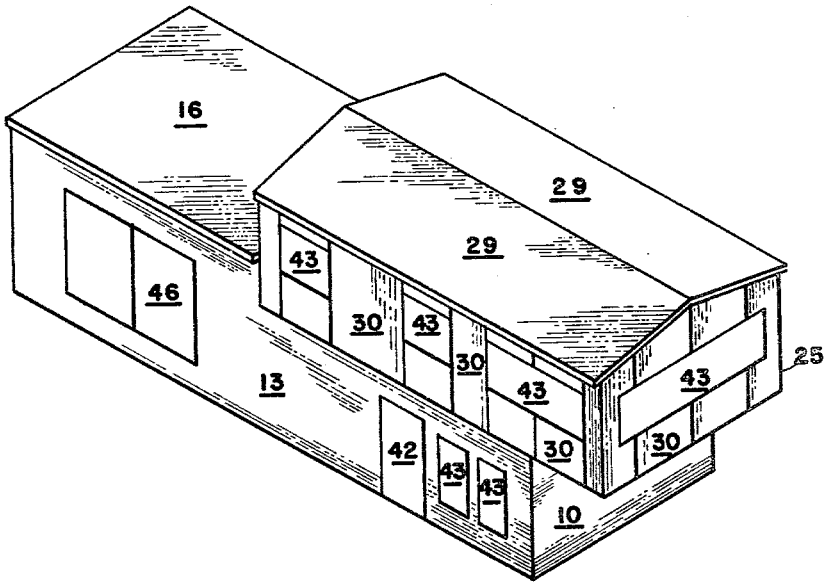
FIG. 4 is a perspective view of a completed dwelling of the present invention.

Field-constructed upper front wall 25, upper rear wall 26 and upper side walls 27 and 28 are erected from easily handled components about the perimeter of third floor 22 when the module is in the ultimate site intended for the finished dwelling. Upper roof 29 is built upon and suspended by said upper wall members. FIGS. 1 and 2 exemplify an embodiment of said upper roof having a flat configuration, whereas FIG. 4 illustrates a peaked design. Still other roof designs may be utilized. As shown in FIG. 4, said upper walls are fabricated preferably by interconnected panel units 30 of rectangular configuration. The space generally defined by upper roof 29, third floor 22 and upper walls 25, 26, 27 and 28 is designated the third dwelling compartment 31. In some embodiments, the forward-most extreme of compartment 31 may protrude beyond front wall 10 as an overhanging portion as shown in FIG. 4. In order to obviate the services of a skilled electrician at the time the dwelling is completed by construction of the third dwelling compartment 31, electrical service outlets 44 are incorporated into the third floor 22 of the module, and pre-wired wall panels having on-off control switches may be utilized which connect with electrical terminals in said third floor.

The third dwelling compartment is intended primarily to accommodate bedrooms, and accordingly would not require plumbing service. For this reason, essentially all the plumbing facilities are incorporated into the module at the time of its factory construction. However, provision may be made in the plumbing system of the module to easily accommodate an optional bathroom located in the third dwelling compartment.

Figure 5:
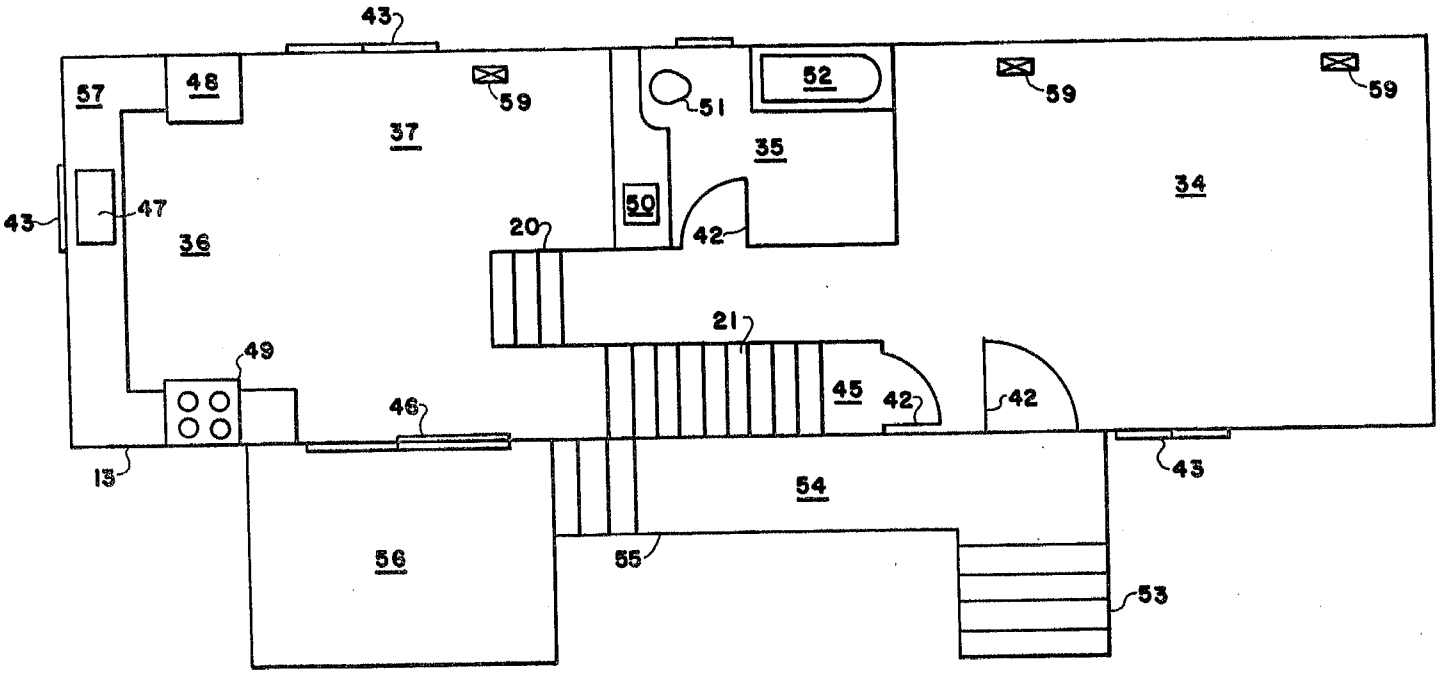
FIG. 5 is a floor plan of an embodiment of the lower two compartments of the dwelling of this invention.
Figure 6:
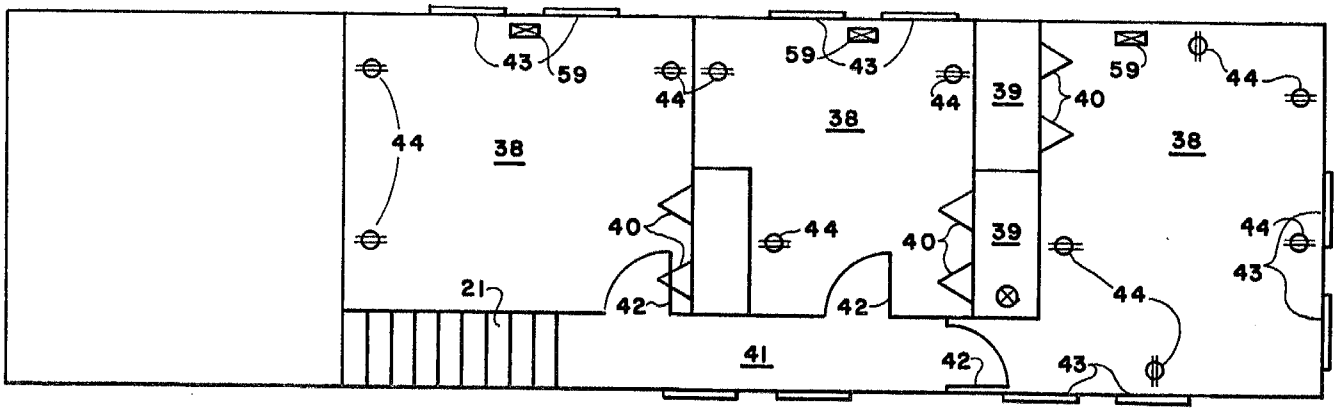
FIG. 6 is a floor plan of an embodiment of the third compartment of the dwelling of this invention.

Each of the three aforementioned dwelling compartments may be subdivided into separate rooms or activity areas, as shown in FIGS. 5 and 6. The module, in preparation for its transportation, is equipped with wheels 32 mounted on axle 57 supported by brackets 58, and a trailer hitch coupling 33 so that the module may be transported as a trailer unit the underside of which may be disposed 6 to 12 inches above the highway. Once at its intended site, the module is immobilized and may be rested upon a foundation structure upraised from the ground, said foundation being fabricated of logs, cinder block, concrete, steel, or the like and extending into the ground as a footing structure. After placement upon a foundation, apurtenances may be built onto the dwelling such as a porch, patio, garage, stairs, railings, additional rooms and the like.

Windows are positioned within the exterior walls of said three dwelling compartments at optional locations for particular functionality and styling effects. Doors leading into the module are located preferably in the lowermost first compartment, but may be placed in the second compartment with the utilization of an outside staircase or raised ground level.

The storage compartment, in addition to functioning as a place for the storage of miscellaneous items, may also house a heating and cooling system, a water heater or other utilities.

The specific floor plans and utilization of available space in the dwelling may be arranged in various manners well known in the housing industry. In the preferred floor plans shown in FIGS. 5 and 6, the lowermost or first compartment 23 will generally house a living room 34 and bathroom 35. The middle or second compartment 24 will house the kitchen 36 and dining area 37. The uppermost or third compartment will contain bedrooms 38 including storage closets 39 having fold-out doors 40. Said bedrooms open onto hallway 41 via doors 42. Electrical outlets 44 and hot air registers 59 are installed in the floors of said bedrooms. Windows 43 are positioned throughout the several rooms of the three dwelling compartments. The area under long staircase 21 may be utilized as a storage closet. Sliding glass door panels 46 are installed into wall 13 adjacent the kitchen and dining areas 36 and 37 respectively. The kitchen area is equipped with a counter 57, wash basin 47, refrigerator 48 and stove 49. The bathroom is equipped with a sink 50, water closet latrine 51 and bathtub 52. An outside raised patio is comprised of a first staircase 53 leading from ground level to foundation floor 14, a walkway 54 and a second staircase 55 leading onto patio 56 which is substantially coplanar with second floor 15. It should be noted that, because the three floors of the dwelling are part of the factory-made module, said floors and connecting staircases can be quite readily provided with substantially continuous carpeting.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

PRIOR ART STATEMENT

With respect to the invention described in the attached specification, the following is the closest prior art of which the Applicant and the preparer of the specification are aware:

U.S. Pat. No. 3,832,811 to Briel discloses a folded housing module which can be used to erect a building at a chosen site.

U.S. Pat. No. 3,629,983 to Jenn concerns preconstructed building modules which can be interconnected at a desired location.

U.S. Pat. No. 3,609,929 to Brown et al relates to a prefabricated modular box-shaped half segment, two of which are connected to form an enclosed unit.

U.S. Pat. No. 3,510,997 to Ratych discloses room-size building elements which can be assembled to form a dwelling.

U.S. Pat. No. 3,422,582 to Van Der Lely concerns a prefabricated building of at least two stories assembled from box-shaped sections and provided with stairways.

U.S. Pat. No. 3,292,327 to Van Der Lely relates to a building assembled from a number of prefabricated box-shaped elements.

U.S. Pat. No. 2,154,142 to Whelan discloses a portable building comprising a pair of prefabricated building units wherein the doors are critically positioned.

Further delineation of the relevancy of the prior art references cited above may be found in said specification.

Copies of the aforesaid references are enclosed herewith.

Having thus described my invention, what is claimed is:

1. A transportable housing module adapted for use in the construction of a dwelling comprising a first and a second dwelling compartment positioned above a rectangular foundation floor extending the entire length and width of said module, exterior vertical side walls and end walls circumscribing the perimeter of said foundation floor, an interior wall parallel to said end walls and substantially centrally disposed with respect to the length of said foundation floor, a short staircase extending from said foundation floor in said first compartment to a second floor of said second compartment, a long staircase positioned adjacent said short staircase angled in the opposite direction therefrom and extending from said second floor to a third floor positioned at a higher elevation than said second floor and laterally displaced therefrom, and a first roof positioned atop the exterior walls bounding said second compartment at an elevation above said third floor, whereby a storage compartment is defined by said foundation floor, second floor, exterior walls and interior wall, and said third floor is adapted to support an assembly of structural components which define a third dwelling compartment.

2. The module of claim 1 comprising substantially all the plumbing and electrical components required in a completed dwelling and wherein electrical service receptacles for said third dwelling compartment are installed in the upper surface of said third floor.

3. The module of claim 1 which comprises the major portion of a split level dwelling derivable therefrom and wherein the elevation of said first roof is below the maximum permissible elevation for transportation on a public highway.

4. The module of claim 3 wherein each of said dwelling compartments has an interior height of at least seven feet.

5. The module of claim 4 having been constructed by factory methods and materials and adapted to be transported over public highways as a trailered unit.

6. A dwelling constructed on a given site from the module of claim 1 comprising a split level building having a storage compartment, two factory-fabricated dwelling compartments and a third dwelling compartment assembled by the interconnection of structural components at said site.

7. The module of claim 5 wherein the interior height of said storage compartment is between about 25 and 50 inches.

* * * * *